US011262047B2

(12) United States Patent
Probst

(10) Patent No.: US 11,262,047 B2
(45) Date of Patent: Mar. 1, 2022

(54) DISPLAY UNIT, DISPLAY APPARATUS CONTAINING AT LEAST ONE DISPLAY UNIT, AND USE OF THE DISPLAY UNIT AND THE DISPLAY APPARATUS

(71) Applicant: Volker Probst, Berlin (DE)

(72) Inventor: Volker Probst, Berlin (DE)

( * ) Notice: Subject to any disclaimer, the term of this patent is extended or adjusted under 35 U.S.C. 154(b) by 201 days.

(21) Appl. No.: 16/329,149

(22) PCT Filed: Aug. 31, 2017

(86) PCT No.: PCT/EP2017/071884
§ 371 (c)(1),
(2) Date: Jun. 24, 2019

(87) PCT Pub. No.: WO2018/041957
PCT Pub. Date: Mar. 8, 2018

(65) Prior Publication Data

US 2019/0316756 A1 Oct. 17, 2019

(30) Foreign Application Priority Data

Aug. 31, 2016 (DE) ..... 10 2016 216 381.7

(51) Int. Cl.
*F21V 11/14* (2006.01)
*F21V 31/00* (2006.01)
(Continued)

(52) U.S. Cl.
CPC ..... *F21V 11/14* (2013.01); *F21V 31/005* (2013.01); *G09F 13/22* (2013.01); *G09F 27/007* (2013.01);
(Continued)

(58) Field of Classification Search
CPC ..... F21V 11/14; F21V 31/005; G09F 13/22; G09F 27/007; G09F 27/008;
(Continued)

(56) References Cited

U.S. PATENT DOCUMENTS 6,549,179 B2 4/2003 Youngquist et al.
8,558,755 B2 10/2013 Kharrati et al.
(Continued)

FOREIGN PATENT DOCUMENTS

DE 10 2012 205 978 A1 10/2013
EP 0 981 124 A2 2/2000
(Continued)

OTHER PUBLICATIONS

International Search Report for Application No. PCT/EP2017/071884 dated Nov. 20, 2017, 6 pages.

*Primary Examiner* — Joseph L Williams
*Assistant Examiner* — Jose M Diaz
(74) *Attorney, Agent, or Firm* — Seed Intellectual Property Law Group LLP

(57) ABSTRACT

A display unit includes a transparent or translucent layer with a display side and a rear side, with an opaque or semitransparent layer on the display side, containing a plurality of apertures, a plurality of illuminants which are present at, or at a distance from, the rear side of the transparent or translucent layer, at least partly embedded in the layer, wherein at least one illuminant is substantially behind one of the apertures in each case configured and designed to emit light in the direction of and through the aperture, a transparent or translucent lamination ply adjoining the opaque or semitransparent layer and covering the plurality of apertures, and a transparent or translucent protective layer adjoining this lamination ply. Also disclosed are a display apparatus and a traffic guidance system comprising such a display unit, and use of the display unit as a media energy façade or a daylight display.

36 Claims, 4 Drawing Sheets

(51) Int. Cl.

| | |
|---|---|
| ***G09F 13/22*** | (2006.01) |
| ***G09F 27/00*** | (2006.01) |
| ***F21Y 115/00*** | (2016.01) |
| ***F21Y 113/00*** | (2016.01) |
| ***G09F 13/04*** | (2006.01) |

(52) U.S. Cl.
CPC ..... *F21Y 2113/00* (2013.01); *F21Y 2115/00* (2016.08); *G09F 13/0472* (2021.05); *G09F 2013/222* (2013.01)

(58) Field of Classification Search
CPC ..... G09F 27/005; G09F 2013/0472; G09F 2013/222; G09F 9/33; G09F 19/22; F21Y 2115/00; F21Y 2113/00
See application file for complete search history.

(56) References Cited

U.S. PATENT DOCUMENTS

| | | | | |
|---|---|---|---|---|
| 2011/0175533 | A1* | 7/2011 | Holman | E04B 9/32 315/130 |
| 2015/0068580 | A1 | 3/2015 | Probst | |
| 2018/0131225 | A1* | 5/2018 | Greene | H02J 7/35 |

FOREIGN PATENT DOCUMENTS

| | | | |
|---|---|---|---|
| EP | 2 226 780 | A1 | 9/2010 |
| WO | 2007/077466 | A2 | 7/2007 |

* cited by examiner

DISPLAY UNIT, DISPLAY APPARATUS CONTAINING AT LEAST ONE DISPLAY UNIT, AND USE OF THE DISPLAY UNIT AND THE DISPLAY APPARATUS

BACKGROUND

Technical Field

The present disclosure provides a display unit and a display apparatus, in some cases a façade or a façade element, containing at least one display unit of the present disclosure. The present disclosure further relates to a traffic guidance system comprising at least one display unit according to the present disclosure. Finally, the present disclosure relates to use of the display unit of the disclosure and the display apparatus of the present disclosure as a daylight display or as a component of a daylight display.

Description of the Related Art

Displays are available in a wide range of sizes and designs, such as smartphone or calculator displays or as large-area advertising displays on external façades of buildings or as freestanding objects. Displays are used both for decorative purposes and as conveyers of information. Displays are based on the use of suitable illuminants. While backlighting was initially provided using neon tubes, today, LED illuminants or OLED illuminants are used. LED displays are described, e.g., in EP 981 124 and U.S. Pat. No. 6,549,179. U.S. Pat. No. 8,558,755 describes large-area LED display systems. With large-area displays, such as those used for advertising purposes or for display or video panels for sports arenas, it has become common for these to remain identifiable and non-functioning for every observer when switched off. This often has a negative impact on the appearance of a building or building ensemble.

Accordingly, there is a need to access display units that do not have the disadvantages of the prior art and that are usable for a very wide range of purposes, which are suitable both as information providers and for decorative purposes, including during daylight, and which when switched off are not immediately identifiable by the observer as display units, but which in some cases are even integratable into existing designs.

BRIEF SUMMARY

Accordingly, the present disclosure provides a display unit, comprising:

(Embodiment 1)

a1) a transparent or translucent layer with a display side and a rear side, containing at least one opaque or semitransparent, in some cases applied layer on the display side, containing a plurality of apertures, b1) a plurality of illuminants, in some cases in the form of an illuminant array, which is partly or fully embedded in the transparent or translucent layer, at, or at a distance from the rear side of the transparent or translucent layer, wherein at least one illuminant is substantially present behind one of the aperture openings, in each case configured and designed to emit light in the direction of said aperture and through said aperture, c1) a transparent or translucent lamination ply, in some cases a laminate foil, indirectly or directly adjoining the opaque or semitransparent layer and covering the plurality of apertures, d1) a transparent or translucent protective layer, in some cases a protective plate, adjoining said lamination ply, and e1) optionally, at least one mounting element connected to the rear side of the transparent or translucent layer; or (Embodiment 2)

a2) a transparent or translucent layer with a display side and a rear side, containing at least one opaque or semitransparent, in some cases applied, layer on the rear side, containing a plurality of apertures, b2) a plurality of illuminants, in some cases in the form of an illuminant array, wherein the illuminants are behind and/or partly or fully in the opaque or semitransparent layer, and wherein in each case, at least one illuminant is arranged in the area of an aperture, in each case configured and designed to emit light in the direction of said aperture and through said aperture, c2) and further, optionally, an optionally transparent or translucent lamination ply, in some cases a laminate foil, and/or a protective layer indirectly or directly adjoining the opaque or semitransparent layer and covering the plurality of apertures, d2) optionally a carrier layer, adjoining the opaque or semitransparent layer or on the lamination ply or on the protective layer, in some cases on the opaque or semitransparent layer, and e2) optionally, at least one mounting element connected to the carrier layer; or (Embodiment 3)

a3) an opaque or semitransparent carrier plate with a rear side and an opposite display side containing a plurality of apertures, b3) a plurality of illuminants, in some cases in the form of an illuminant array, on the rear side of the carrier plate, wherein the apertures are closed or filled with a transparent or translucent material, in some cases closed or filled in a weatherproof manner, and/or c3) wherein at least one weather protection layer and/or diffusor layer is present between the carrier plate and the plurality of illuminants.

BRIEF DESCRIPTION OF THE SEVERAL VIEWS OF THE DRAWINGS

Further features and advantages of the present disclosure are indicated by the following description, in which exemplary embodiments of the present disclosure are explained by the way of example using schematic drawings, without thereby restricting the present disclosure. These show as follows:

FIG. 7 is a schematic top view onto the display unit shown in FIG. 6 when switched on;

FIG. 9 is a schematic top view onto the display unit shown in FIG. 8 when switched on.

DETAILED DESCRIPTION

Figure 1:
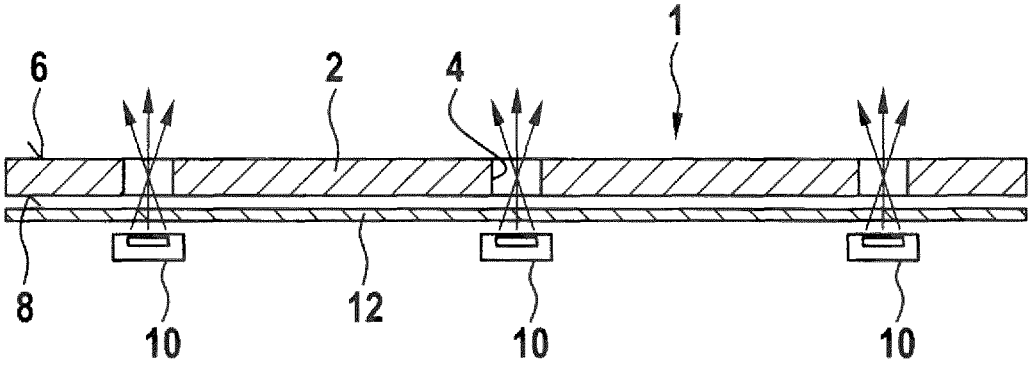
FIG. 1 is a schematic cross-section view of an embodiment of a display unit of the present disclosure.

With a display unit according to Embodiment 1 above, an illuminant is provided behind an aperture, according to the present disclosure, when the aperture carrier, i.e., the opaque or semitransparent layer, is arranged on the side facing away from the display side and is configured and designed to be able to guide light through the aperture. Accordingly, the illuminant no longer needs to lie directly behind an aperture, but can also be arranged offset at the side, for example such that the illuminant is no longer visible from the display side through the aperture. The same applies to the attachment of the illuminant of the display unit according to Embodiment 2 above.

In some cases the display unit according to Embodiment 2 has one, optionally transparent or translucent, lamination ply, in some cases laminate foil, and/or a protective layer, which lies indirectly or directly on the opaque or semitransparent layer and which covers the plurality of apertures. Additionally, it has been shown to be advantageous to provide a carrier layer adjoining the lamination ply or the protective layer. Additionally, for reasons of practicability, at least one mounting element can be connected to the carrier layer.

With the display unit of the present disclosure, the transparent or translucent layer or carrier plate (in Embodiment 3) or the opaque or semitransparent layer can be single- or multilayered. The opacity or semitransparency of the single- or multilayered opaque or semitransparent layer or of the carrier plate can be maintained through the use of at least one opaque or semitransparent layer.

In some cases effective and economically efficient display units of the present disclosure are also obtained due to the fact that the opaque or semitransparent layer is or contains a coating, in some cases applied in a vacuum, evaporated or sputtered on, or using a CVD method or a wet chemical or electrochemical separation method.

For outdoor applications, it has been shown to be advantageous when the apertures are filled in the opaque or semitransparent layer with a transparent or translucent material. In this manner, the length of service life of the display units of the present disclosure can be significantly increased.

With the present disclosure, "transparent" means that a corresponding transparent material has a degree of transmission >0.4, i.e., it transmits more than 50% of the incoming visible light. The degree of transmission T is defined as the quotient between the light intensity I behind an obstacle and the light intensity $I_o$ in front of an obstacle.

$$T=I/I_o$$

The obstacle according to the principle of the above definition is an even, planar ply of the transparent material with a ply thickness of 10 μm, optionally 100 μm, which the light beam hits vertically. In some cases the degree of transmission of a transparent material thus determined of the present disclosure is ≥0.8, in some other cases ≥0.9. The degree of transmission or the light intensities are determined at a wavelength of 470 nm, 550 nm or 650 nm. It is sufficient for the present disclosure when the transparency property is met for at least one of the above wavelengths, advantageously however for at least the wavelength of 650 nm. In some cases it has been found to be advantageous when the degree of transmission has the aforenamed degree of transmission for all three named wavelengths.

With the present disclosure, "semitransparent" means that a corresponding transparent material has a degree of transmission of 0.1 to 0.5. Optionally, the degree of transmission of a semitransparent material thus determined according to the principle of the present disclosure is 0.2 to 0.5, in some cases 0.4 to 0.5. The degree of transmission is determined in the same way as for transparent materials. The degree of transmission or the light intensities are determined at a wavelength of 470 nm, 550 nm or 650 nm. According to this definition according to the principle of the present disclosure, it should be sufficient when the semitransparency property is met for at least one of the above wavelengths, advantageously however for at least the wavelength of 650 nm. In some cases it has been found to be advantageous when the degree of transmission has the aforenamed degree of transmission for all three named wavelengths. If a material has degrees of transmission of semitransparency for some wavelengths and transparency for other wavelengths, the material should be regarded as being transparent, wherein optionally, however, the determination at the wavelength of 650 nm is decisive.

Satisfactory display properties are also obtained with the display units of the present disclosure wherein the light emitted from an illuminant penetrates through a corresponding aperture in part, optionally in large part, and/or that the illuminants are centered in each case in relation to at least one geometric axis of the corresponding apertures, and/or that the illuminants are each located in alignment with corresponding apertures. In this case it has been found to be advantageous when substantially each illuminant is arranged in alignment with a corresponding aperture. An illuminant is in alignment with an aperture according to the principle of the present disclosure when the light beam emitted from the illuminant runs substantially vertical to the area tensioned in front of the aperture.

Such display units according to the present disclosure have been shown to be advantageous in which the apertures are linear, in some cases having the form of slit apertures, or in some further cases are circular, rectangular or square apertures. In some cases, with apertures in the form of linear apertures, an unexpectedly intensive light effect is obtained, including with very narrow slits, and above all also due to the fact that a plurality of such linear apertures are arranged adjacent to each other.

Here, display units of the present disclosure of this type with in some cases intensive illuminant effects are obtained, in which the average or maximum width of at least one, in some cases substantially all, linear apertures is smaller than or equal to 100 μm, optionally smaller than or equal to 50 μm, and in some cases advantageously, smaller than or equal to 30 μm. Alternatively, the average or maximum size, in further cases width, of the optionally linear apertures can also extend up to 5 mm, in some cases up to 3 mm. In some cases it has also been shown to be effective in relation to the optical appearance of the display units of the present disclosure that the average lateral space apart of adjacent apertures and/or illuminants lies in the range of 0.1 cm to 10 cm, optionally in the range of 0.5 cm and 8 cm, and in further cases in the range of 1 to 6 cm.

According to a further embodiment of the present disclosure, on the display side of the display units, the areas between adjacent apertures are partly or in some cases entirely dark or blackened. In this manner, the contrast of the display unit can again be increased.

A wide range of optical effects can be obtained with the display units of the present disclosure. For this purpose, it can be provided, for example, that at least one lens and/or at least one prism and/or at least one diffusor are present in front of and/or behind an aperture. In the manner described, the optical impression that can be produced with the display unit of the present disclosure can be varied to a wide degree. As a result, a very large degree of creative freedom is enabled.

The transparent or translucent layer and/or the transparent or translucent protective layer, in some cases the protective plate, of the display unit of the present disclosure, can be or comprise a glass pane, e.g., a glass window pane, or a transparent or translucent plastic plate or foil, in some cases a polycarbonate or PMMA plate or foil.

For the illuminant of the display units of the present disclosure, a plurality of known illuminants can be used. In some cases intensive lighting effects can be obtained with the use of illuminants selected from the group consisting of LEDs, OLEDs, laser diodes and mixtures of these. Here, suitable LEDs can be selected from the group consisting of wired LEDs, SMD-LEDs, RGB-LEDs, in some cases SMD-RGB-LEDs, Superflux-LEDs, COB-LEDs and QLEDs, and advantageously are present in the form of an LED array. The illuminants, in some cases the LEDs, are optionally dimmable. Here, too, the desired color and/or intensity can be set.

In one embodiment the illuminants are provided by an illuminant surface, in some cases a flat illuminant matrix with paneled illuminants or a continuous illuminated surface. This can be an LED matrix or an OLED surface, for example. This design is in some cases suitable, for example, for displays, wherein each dot in the matrix corresponds to one subpixel.

By contrast, in another design, it is provided that illuminants arranged linearly or in strips or illuminant surfaces are used. In some cases marginal arrangements of LED rows or parallel multiple rows are advantageous, which form illuminant lines or illuminant strips. This design is in some cases suitable for illumination surfaces or displays that are constructed of several thin layer solar modules.

Precisely reproducible display units of the present disclosure are in some cases also obtainable in that the apertures are formed using laser treatment, in some cases laser structuring, advantageously of areas of the opaque or semitransparent layer, or using lithographic methods, milling, plasma cutting, laser cutting, electron beam cutting, glass bead blasting, sandblasting, etching methods and/or water jet cutting. This also applies in some cases when the opaque or semitransparent layer is formed from a coating, in some cases applied in a vacuum, separated using sputtering or evaporation, or applied using a CVD method or a wet chemical or electrochemical separation method. For this purpose, for example, recourse can be made to the processing or structuring of coated glass plates of $3.2\times6$ $m^2$ in size, for example.

For many applications, it has been shown to be advantageous to use display units in which the average or maximum width of at least one, in some cases substantially of all, linear apertures is smaller or equal to 100 μm, optionally smaller than 50 μm, optionally less than or equal to 50 μm, and advantageously, less than or equal to 30 μm, and/or in which the average lateral space apart of adjacent apertures and/or illuminants lies in the range of 0.1 cm to 10 cm, optionally in the range of 0.5 cm and 8 cm, and advantageously, in the range of 1 to 6 cm.

Here, display units of the present disclosure of this type are advantageous with which the average or maximum width of at least one, in some cases substantially all, apertures, optionally circular, rectangular or square apertures, is smaller than or equal to 15 mm, optionally smaller than or equal to 7 mm, and advantageously, smaller than or equal to 3 mm. Alternatively or in addition, the average lateral space apart of adjacent apertures and/or illuminants is in the range of 100 times to the simple average or maximum width, optionally in the range of ten times to the simple average or maximum width, and advantageously, in the range of five times to double the average or maximum width, of the aperture.

With highly efficient display units of the present disclosure in some cases a very good resolution can already be obtained in that the entire surface of the apertures, in relation to the total surface of the display side of the display unit, is smaller than or equal to 5%, optionally smaller than or equal to 2%, and in some cases advantageously, smaller than or equal to 0.5%. Furthermore, such display units of the present disclosure in which the entire surface of the apertures of a solar cell are advantageous, in relation to the total surface of this solar cell, is set at less than or equal to 20%, optionally less than or equal to 15%, and advantageously, less than or equal to 10%, and in some cases, less than or equal to 5%.

In some cases, when the proportion of the area used for the apertures is to be kept small, it has been shown to be advantageous to provide a diffusing pane between the illuminants and the apertures.

The carrier layer and/or the carrier plate and/or the mounting element of a display unit of the present disclosure can for example comprise or consist of a construction element, in some cases a plate, consisting of or containing glass, metal, plastic, ceramic, stone, concrete or wood.

In an another embodiment of the display unit of the present disclosure, it is provided that this further contains at least one temperature, humidity, visibility and/or vibration sensor and/or at least one camera unit. In a advantageously design, an operating panel is provided that is connected via a control unit with the display unit of the present disclosure, or is connected to the display unit, and which enables the design of the content and form of the media, design and/or information content to be set individually.

The functionality of the display units of the present disclosure can be further increased when on or connected to the opaque or semitransparent ply or the carrier plate, at least one photovoltaic solar cell each on the display side or at least one photovoltaic solar module, in some cases a photovoltaic thin layer solar module, is present. Here, too, it can be provided that the opaque or semitransparent ply contains or is formed from at least one photovoltaic solar cell or at least one photovoltaic solar module.

Additionally, with the display units of the present disclosure, such embodiments are included in which on or connected to the rear side of the transparent or translucent layer or the carrier plate, at least one photovoltaic solar cell or at least one photovoltaic solar module, in some cases a photovoltaic thin layer solar module, is present.

An advantageous connection of display function and photovoltaic energy generation is also provided with such display units of the present disclosure in which the apertures are present between adjacent photovoltaic solar cells, so that an integrated series connection of the solar cells is possible or provided, or that the apertures are based on structures, in some cases laser structures, of the photovoltaic solar cells or photovoltaic solar modules. In one advantageous embodiment, the apertures can overlap with the corresponding photovoltaic solar cells, optionally the cell areas, and advantageously, within the cell areas of the photovoltaic solar cells.

The photovoltaic solar cell or the photovoltaic solar module can be based on polycrystalline silicon, multicrystalline silicon, monocrystalline silicon, amorphous silicon, chalcopyrite silicon, in some cases CIS and CIGS systems, kesterite systems, perovskite systems, cadmium/telluride systems or organic systems. The chalcopyrite system is optionally based on the alloy $CU(In_{1-X}Ga_X)$ $(Se_{1-y}, S_y)$ wherein x and y assume values between 0 and 1. In the display units of the present disclosure, it is optionally provided that the at least one solar module, in some cases the thin layer solar module, comprises a plurality of monolithically integrated, serially connected solar cells, which are in each case separated from each other by apertures situated at a distance from each other.

A further embodiment of the display unit of the present disclosure comprises at least one wire connected or wireless data processing device, which is designed and configured to issue information, in some cases by way of written texts, graphics, images or films, on the display, wherein illuminants are selectively triggerable. With the data processing device, the data captured by the temperature, humidity, visibility and/or vibration sensors and/or the camera(s) can also be stored, transferred and/or evaluated.

In the case of autonomous use of the display unit of the present disclosure, it can be provided that this further comprises an energy storage system, in some cases a chargeable battery. Optionally, this display unit also has a charging regulation for implementing the battery charging, which is optionally feedable with the electrical energy from the solar cells or solar modules. Here, in a further embodiment of the present disclosure, it is also advantageous that the electrical energy for operating the illuminants and/or the at least one temperature, humidity, visibility and/or vibration sensors and/or the at least one camera unit is providable at least partly from the photovoltaic solar cell or from the photovoltaic solar module or from the at least one energy storage system, in some cases the chargeable battery.

The present disclosure further provides a display apparatus having a front and rear side, containing at least one display unit of the present disclosure. The display apparatus of the present disclosure can for example be a façade, such as a curtain façade, a display panel or a video screen.

In advantageous embodiments, such display units or display apparatuses of the present disclosure are also provided with which the apertures are not attached in every solar cell, but only in every second, third, fourth, or n-th/$n^{th}$ solar cell. As a result, the photovoltaic areas with cells equipped with apertures are generally less than with the neighboring cells without apertures. Accordingly, the photocurrents generated in these cells with the apertures can be less. In practice, this can lead to electrical losses during adaptation, i.e., the cell with the lowest photocurrent will then generally determine the total current of the module in series connection. Such a case can also be practically applied when the area loss as a result of the sum of all apertures in a cell is significantly lower than for the total area of the cell. With the present disclosure, the area loss as a result of the apertures can, e.g., not amount to more than 10% or not more than 5%. With the present disclosure, such embodiments are also realizable with which apertures are installed for every second, third, fourth or generally n-th/$n^{th}$ cell. However, with regard to the minimization of the electrical adjustment losses, it is advantageous, however, that each cell contains apertures, in some cases the same number of apertures, and/or the same percentage area allocation by apertures. One advantage of the display units of the present disclosure is that through the variable design in relation to the attachment of apertures in every, every second, every third or every $n^{th}$ cell, the cell layout, the module design and/or the optical specifications can be widely varied.

The flexibility of the display apparatus of the present disclosure also optionally comes to bear with such embodiments in which the rear side of at least one first display unit of the present disclosure, in some cases the rear side of the transparent or translucent layer of said display unit or the rear side of the opaque or semitransparent carrier plate of said display unit, and the rear side of at least one second display unit of the present disclosure, in some cases the rear side of the transparent or translucent layer of said display unit, or the rear side of the opaque or semitransparent carrier plate of said display unit, face each other and in some cases are at a distance from each other and are arranged forming an interim space. Alternatively or in addition, such embodiments are in this case also provided, with which the rear side of at least one display unit of the present disclosure, in some cases the rear side of the transparent or translucent layer of said display unit or the rear side of the opaque or semitransparent carrier plate of said display unit, and the rear side of the at least one photovoltaic solar cell or the at least one photovoltaic solar module, face each other and in some cases are at a distance from each other and are arranged forming an interim space. In this manner, it can be ensured that the compass orientation does not have to be taken into account when setting up and aligning the display unit. In this way, the display unit can use solar energy both from the front side and from the rear side.

With the embodiments described above, the option is furthermore offered that in the interim space of the at least one temperature, humidity, visibility and/or vibration sensor and/or the at least one camera unit and/or the at least one energy storage system, in some cases the chargeable battery, and/or the charging regulation and/or the at least one wire connected or wireless data processing device and/or control are arranged. As a result, a very compact and at the same time functional structure is achieved. In one further embodiment of the present disclosure, it can also be provided that the interim space has in some cases circumferential side walls, and optionally is encapsulated. Such an embodiment of a display unit or a display apparatus can, e.g., be used as an element of a traffic guidance system. Several of these display units or display apparatuses, configured at different places and connected via a central wire-connected or wireless data processing and control unit can, e.g., represent or form a traffic guidance system, which can be used, e.g., for the situative regulation of road traffic on land, or for the regulation of shipping traffic on water. An advantage of this traffic guidance system of the present disclosure is also that this can, in some cases, be installed in a wireless version in an optionally simple, fast and low-cost manner. Neither data nor power supply lines are required. The traffic guidance system of the present disclosure can be practically energy autonomous due to the additional photovoltaic function units that are integrated or integratable in the display area, e.g., series-connected solar cells.

The present disclosure is further attained by way of a traffic guidance system, comprising at least one display apparatus of the present disclosure and/or at least one display unit of the present disclosure.

The display unit of the present disclosure and the display apparatus of the present disclosure can for example further be equipped with or be a part of at least one glass window pane, in some cases a partly mirrored glass window pane, containing a rear and an opposite front-side glass pane side, equipped with a plurality of illuminants in the form of LEDs, OLEDs or laser diodes, in some cases embedded in a recess present in the glass window pane, in some cases a groove, wherein the plurality of illuminants is optionally covered with a transparent or translucent material. The display apparatus described above and also the display unit of the present disclosure described above can be used as a window pane. During daylight, this embodiment of the display apparatus of the present disclosure cannot be differentiated in terms of its external appearance when switched off from standard window panes in a façade area. This permits the integration of the display apparatuses of the present disclosure in standard façade designs, and as a result extends the architectural possibilities to a very large degree. On the one hand, the façade functionality, e.g., of the windows as providers of daylight, and on the other the uniform display functionality that is not interrupted by windows, can be maintained, which will be described in greater detail below.

If a display unit of the present disclosure is provided as a window or as part of a window, the apertures can for example be designed in the form of parallel strips or as a grid. It was found that the display function can be integrated in windows or glass window panes without distorting the appearance in the long term and without losing the window function. This is in some cases made possible by the fact that the window area is mirrored in a semitransparent manner in the areas between the apertures. As a result, the display areas or apertures cannot be differentiated from the outside from the semitransparent areas. In other words, with the display units or display apparatuses of the present disclosure, it is possible that the window area of the present disclosure cannot be identified as a display area during daylight when it is switched off. The architectural integrity of the façade is therefore not disturbed by the display technology as a result when the display is switched off. By contrast, when the display is switched on, the entire façade area, including the windows, becomes a media or graphic design façade.

Such display apparatuses of the present disclosure have been shown to be advantageous in which the entire front side and/or the entire rear side or in which a partial area of the front side and/or a partial area of the rear side has the at least one photovoltaic solar cell or the at least one photovoltaic solar module, in some cases the photovoltaic thin layer solar module. As a result, it is possible to render the display apparatus of the present disclosure independent from an external energy supply. The display apparatuses of the present disclosure can accordingly be configured in places where it is not easy to secure an electrical current supply.

The display units of the present disclosure and the display apparatuses of the present disclosure are also characterized by the fact that they are suitable as a media energy façade or as a daylight display or as a component of a daylight display or a media energy façade. The term media energy façade here illustrates the opportunity for multifunctionality of the façade as a result of the display unit of the present disclosure. Due to the photovoltaic function, solar energy can be produced and due to the display function, optical possibilities for media and graphic design are provided. The latter is of particular interest to the advertising industry and for architects. With the display units of the present disclosure and the display apparatuses of the present disclosure, new design opportunities are provided or are developed.

This will be explained below with reference to a media façade containing display units of the present disclosure. Thus, a building shell, e.g., without connecting the display function of the present disclosure, can to a large extent have a selectable, e.g., uniform, architectural design—e.g., within the design opportunities provided by so-called curtain façades, as well as by other façade types. If, for example, the selected type of curtain façade is visually opaque, the display units of the present disclosure can be designed such that the desired apertures are installed in the desired form and at the desired space apart. Depending on the design effect required, different materials can be used for the façade elements, such as different flat glass panes or glass-type materials, without or without photovoltaic thin layer coating, different metal plates or alloys, ceramics or wooden paneling. At the same time, the curtain façade can be used as an LED display. The product obtained is then usually a fully integrated media or graphic design façade. In addition, different colored laser diodes with or without additional optics can be integrated into the LED display in order to create special three-dimensional effects, e.g., from building to building.

A façade can be used as a media façade over its entire surface or partial surface. For example, the display unit of the present or the display apparatus of the present disclosure can be triggered such that media, advertising or information appear in the foreground as static or moving images. When the display function is switched off, only the architecture of the building appears in the foreground. With a graphic design façade, unlike with the function as a media façade, only the display unit of the present disclosure or the display apparatus of the present disclosure are triggered differently. Then, in general, no media content is transported, the display is used as a design element of the façade, and makes it architecturally variable. Here, for example, a wide range of different colors, color progressions and color variations can be used, e.g., graphic or photographic elements. Desired architectural changes to the building can, e.g., be intensified or strongly modified.

A combination of media and graphic design façade is also possible. The surface of the media or graphic design façade can be designed almost entirely as required, e.g., planar, with diagonals or steps and ledges, circular or, e.g., two- to three-dimensionally curved.

Here, a façade or a building as a whole can communicate very different impressions as combination of form and (multi-)function. Due to the practically unlimited design opportunities resulting from the display units of the present disclosure or display apparatuses of the present disclosure, a façade can be given a very lively design or appearance. A curtain façade can, e.g., be used as a media or graphic design curtain façade.

For example, several, also opposite, façades or also entire streets can be equipped with the display unit of the present disclosure or the display apparatus of the present disclosure and thus become established as convertible media and design façades and become a magnet for the general public. In one embodiment of the present disclosure a control panel can also be used by passers-by to design the media and design façades, as a particular attraction.

The present disclosure further provides a structural body for a display unit, e.g., for a display unit of the present disclosure, comprising:

a first embodiment, comprising:

a1) a transparent or translucent layer with a display side and a rear side, containing at least one opaque or semitransparent, in some cases applied layer on the display side, containing a plurality of apertures; and b1) a plurality of illuminant inlets and/or holders, which are partly or fully embedded in the transparent or translucent layer, at, or at a distance from the rear side of the transparent or translucent layer, wherein at least one illuminant inlet and/or holder is present substantially behind or in one of the apertures; or a second embodiment, comprising:

a2) a transparent or translucent layer with a display side and a rear side, containing at least one opaque or semitransparent, in some cases applied, layer on the rear side, containing a plurality of apertures; and b2) a plurality of illuminant inlets and/or holders, wherein the illuminant inlets and/or holders are present behind and/or partly or fully in the opaque or semitransparent layer and wherein in each case, at least one illuminant inlet and/or holder is arranged in the area of an aperture; or a third embodiment, comprising:

a3) an opaque or semitransparent carrier plate with a rear side and an opposite display side containing a plurality of apertures; and b3) a plurality of illuminant inlets and/or holders on the rear side of the carrier plate.

Here, it can be provided that the first embodiment of the structural body further comprises:

c1) a transparent or translucent lamination ply, in some cases a laminate foil, indirectly or directly adjoining the opaque or semitransparent layer and covering the plurality of apertures;

d1) a transparent or translucent protective layer, in some cases a protective plate, adjoining said lamination ply; and e1) optionally, at least one mounting element connected to the rear side of the transparent or translucent layer; or that the second embodiment of the structural body further comprises:

c2) optionally, an optionally transparent or translucent lamination ply, in some cases a laminate foil, and/or a protective layer indirectly or directly adjoining the opaque or semitransparent layer and covering the plurality of apertures;

d2) optionally a carrier layer, adjoining the opaque or semitransparent layer or on the lamination ply or on the protective layer, in some cases on the opaque or semitransparent layer; and e2) optionally, at least one mounting element connected to the carrier layer; or that the third embodiment of the structural body further comprises that:

the apertures according to b3) are closed or filled with a transparent or translucent material, in some cases in a weatherproof manner; and/or c3) that at least one weather protection layer and/or diffusor layer is present between the carrier plate and the plurality of illuminant inlets and/or holders.

In one advantageous embodiment of the present disclosure, a structural body is here provided, in which the transparent or translucent layer or carrier plate or the opaque or semitransparent layer is single- or multilayered, or that the opaque or semitransparent layer or carrier plate is single- or multilayered, and contains at least one opaque or semitransparent layer.

The designs of features described above for the display unit of the present disclosure, which are also an inherent part of the structural body of the present disclosure, apply in the same manner for this structural body of the present disclosure. This structural body of the present disclosure can also be understood as being an interim product during the production of the display unit of the present disclosure. The structural body of the present disclosure accordingly does not yet contain any illuminants, such as are an inherent part of the display unit of the present disclosure. The structural body of the present disclosure also generally functions without such components, which may first be applied after the illuminants have been attached or inserted for the purpose of completing the display unit of the present disclosure.

In another embodiment of the present disclosure, a structural body of the present disclosure is provided in which the apertures in the opaque or semitransparent layer are filled with a transparent or translucent material.

In a further advantageous embodiment, a structural body of the present disclosure is provided in which the apertures are linear, in some cases having the form of slit apertures, or substantially are circular, rectangular or square apertures.

In another embodiment, a structural body of the present disclosure is further provided in which the transparent or translucent layer and/or the transparent or translucent protective layer, in some cases the protective plate, is or comprises a glass pane, e.g., a glass window pane, or a transparent or translucent plastic plate or foil, in some cases a polycarbonate or PMMA plate or foil.

In a further advantageous embodiment, a structural body of the present disclosure is provided in which the opaque or semitransparent layer is or contains a coating, in some cases applied in a vacuum, separated using sputtering or evaporation, or applied using a CVD method or a wet chemical or electrochemical separation method.

The apertures with the structural bodies of the present disclosure can be formed, e.g., using laser treatment, in some cases laser structuring, optionally of areas of the opaque or semitransparent layer, or using lithographic methods, milling, plasma cutting, laser cutting, electron beam cutting, glass bead blasting, sandblasting, etching methods and/or water jet cutting.

In a further advantageous embodiment, a structural body of the present disclosure is also provided in which the carrier layer and/or the carrier plate and/or the mounting element comprises a construction element, in some cases a plate, consisting of or containing glass, metal, plastic, ceramic, stone, concrete or wood.

In another advantageous embodiment, a structural body is further provided that further contains at least one temperature, humidity, visibility and/or vibration sensor and/or at least one camera unit.

In a further advantageous embodiment, a structural body of the present disclosure is further provided in which on or at the opaque or semitransparent layer or the carrier plate, in each case on the display side, at least one photovoltaic solar cell or at least one photovoltaic solar module, in some cases a photovoltaic thin layer solar module, is present and/or that the opaque or semitransparent layer contains or is formed of at least one photovoltaic solar cell or at least one photovoltaic solar module.

Here, it can optionally also be provided that on or connected to the rear side of the transparent or translucent layer or the carrier plate, at least one photovoltaic solar cell or at least one photovoltaic solar module, in some cases a photovoltaic thin layer solar module, is present.

In another advantageous embodiment, a structural body of the present disclosure is also provided in which the apertures are present between adjacent photovoltaic solar cells or between adjacent photovoltaic solar modules, or that the apertures are based on structures, in some cases laser structures, of the photovoltaic solar cells or photovoltaic solar modules.

Here, such structural bodies of the present disclosure are advantageous in which the apertures overlap with the corresponding photovoltaic solar cells, optionally the cell areas of the photovoltaic solar cells, and advantageously, within the cell areas of the photovoltaic solar cells.

The transparent structural lines that form the apertures can in this case be used in a further embodiment for monolithically integrated series connection. This is in some cases achieved due the fact that the series connection is switched off such that at least the first structuring lines or structuring separating channels are created at the earliest after the production of the photovoltaic semiconductors, and that these structuring lines or structuring separating channels are filled with a transparent filler material. This construction makes it possible, in an advantageous manner, to do without additional apertures. On the rear side of a carrier pane, an LED array may be present, for example, which contains a plurality of illuminants. These illuminants, in some cases LEDs, are optionally located in alignment with the transparent, linear structuring separating channels. In the case of the design with series connection with transparent structuring lines or structuring separating channels, it is advantageous that the loss of area resulting from the apertures can be brought to zero, in some cases when only the separating channels are intended for use as apertures.

In another advantageous embodiment, a structural body of the present disclosure is further provided that further comprises at least one wire connected or wireless data processing device, which is configured and designed to provide information, in some cases by way of written texts, graphics, images or films, on the display, wherein illuminants are selectively triggerable, and/or in order to store, transfer and/or evaluate the data recorded by the temperature, humidity, visibility and/or vibration sensors and/or the camera(s).

In a further embodiment, a structural body of the present disclosure is additionally provided that further comprises at least one energy storage system, in some cases a chargeable battery, and optionally further a charging regulation for implementing the battery charging, which is advantageously feedable with the electrical energy from the photovoltaic solar cells or the photovoltaic solar modules.

The present disclosure provides display units and display apparatuses and structural bodies for display units that are distinguished by their broad range of use. With the display units of the present disclosure, the very flexible optical design of façades is rendered possible, even during daylight, in some cases when switched off, as well as at night or in darkness when the display function is switched on. Thus, with the display units of the present disclosure, façades can be obtained that during daylight and when switched off do not differ from standard façades, but which at night provide a media façade. In this manner, the display unit of the present disclosure or the display apparatus of the present disclosure become an integral part of the exterior of a building façade. Thus, the design of the display unit or display apparatus of the present disclosure can easily be adapted to the design of the surrounding area. This applies in some cases to the incorporation of window areas, which are also used as display apparatuses containing display units of the present disclosure. A further advantage lies in the fact that with the display units of the present disclosure, through the incorporation of photovoltaics that do not disturb the overall optical impression, electrical energy can be produced with the aid of which autonomous operation of display units or display apparatuses is enabled, for example.

A wide range of façade types can be fitted with the display units or display apparatuses of the present disclosure, such as the curtain façade. As a result, with the display units and display apparatuses of the present disclosure, façades are obtained such as curtain façades, which have a fully integrated media or graphic design façade. When the illuminants are connected to a data processing system, a display unit of the present disclosure or a display apparatus of the present disclosure can be used over the entire surface or only in partial areas. Media, advertising or information content can also be displayed as static or moving images using these display units or display apparatuses. Additionally, the display unit of the present disclosure or the display apparatus of the present disclosure can be used to generate particular architectural effects when switched on. Naturally, media and graphic design aspects can be combined when designing a façade. It is also advantageous that when display units of the present disclosure or display apparatuses of the present disclosure are used, the surface of buildings can be designed in almost any way required in the form of media or graphic design façades, for example planar, with diagonal steps and ledges and/or two- or three-dimensionally curved. Naturally, the display units of the present disclosure or display apparatuses of the present disclosure can also be used in the interior of buildings or as a separating wall.

It has also proved to be advantageous that the areas between adjacent apertures can be assigned for the installation of solar cells.

Solar cells or solar modules are generally opaque. Apertures can be obtained in a simple manner with solar cells or solar modules through structuring, in some cases laser structuring, or through lithography. This also applies in some cases to thin layer solar cells, such as CIS and CIGS thin layer solar cells. Here, it is also advantageous that using laser structuring and lithography, any desired geometries and designs of apertures can be obtained, such that the loss of area due to the entire area of all apertures attached can be kept very low. At the same time, an adequate display function is guaranteed.

With the aid of display units of the present disclosure or display apparatuses of the present disclosure, remote controlled, autonomous energy displays are available which can be triggered via radio connection, for example. Thus, display panels are obtained that can quickly and conveniently be equipped with new information content and displays. This enables the use of autonomous energy traffic guidance systems on water and on land.

Finally, it was found that the quality of display units or display apparatuses of the present disclosure can be improved through the integration of a range of different sensors and/or cameras, in some cases when coupled with a data processing system. For example, depending on the number of observers or passers-by present in front of a display apparatus, the content shown on the display unit or display apparatus can be varied.

Turning in particular to the drawings, FIG. 1 shows the representation of a display unit 1 of the present disclosure with an opaque layer 2, e.g., in the form of a metal or stone panel, containing a plurality of apertures 4. The opaque layer 2 has a display side 6 and a rear side 8. On the rear side 8, i.e., behind the apertures 4, illuminants 10 are present. These can be an array of LEDs, for example. In the embodiment shown, these are arranged such behind the apertures 4 that light can penetrate directly through these apertures. Between the illuminants 10 and the opaque layer 2, a weather protection layer 12 is present which in the embodiment shown also acts as a diffusor panel.

Figure 2:
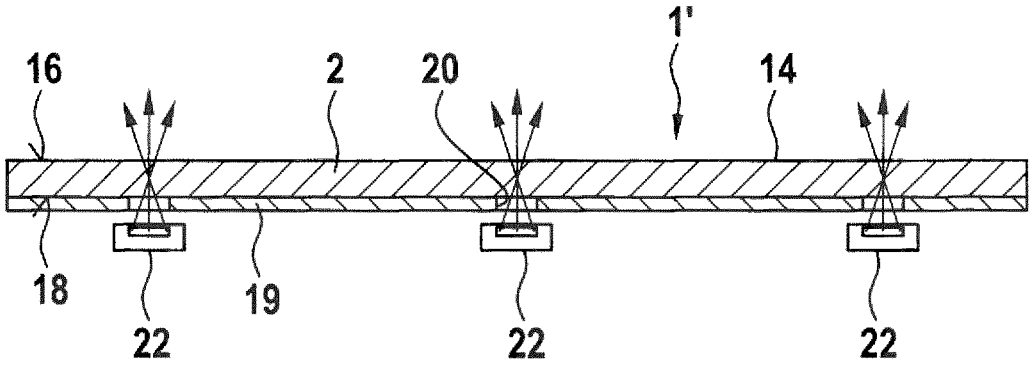
FIG. 2 is a schematic cross-section view of a further embodiment of a display unit of the present disclosure.

With the display unit 1' shown in FIG. 2, the opaque layer 2 is formed from a transparent layer 14, e.g., from glass, with a display side 16 and a rear side 18. On the rear side 18 of this transparent layer 14, an opaque layer 19 is present, for example in the form of an evaporated titanium nitride layer. Apertures 20 can be worked into this opaque layer using laser structuring. The illuminants 22 are present behind these apertures 20.

Figure 3:
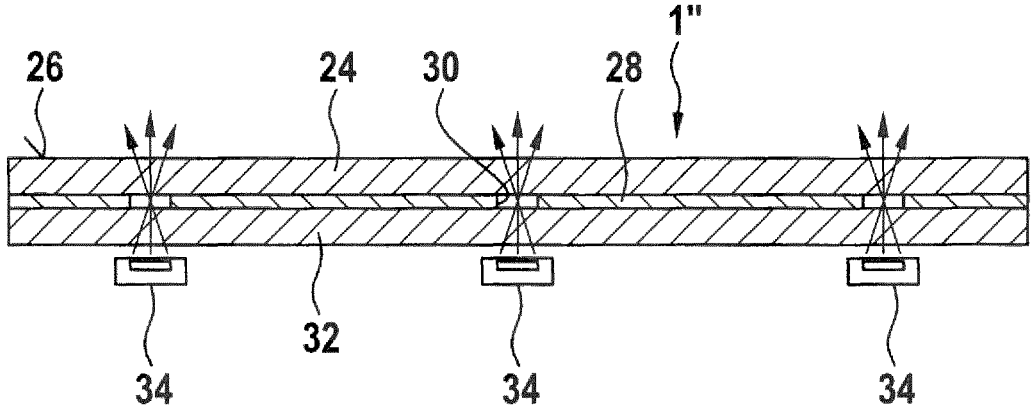
FIG. 3 is a schematic cross-section view of a further embodiment of a display unit of the present disclosure.

FIG. 3 shows a further embodiment of a display unit of the present disclosure 1" with a solar module layer 24 on the display side 26 of the display unit 1". On said solar module layer, or as an inherent part of the solar module layer, an opaque layer 28 is present into which apertures 30 have been worked, e.g., using laser structuring. A transparent carrier layer 32 abuts the opaque layer 28 containing the apertures 30. In the area behind the respective apertures, one illuminant 34 is present in each case, via which the light can be emitted in the direction of the apertures 30.

Figure 4:
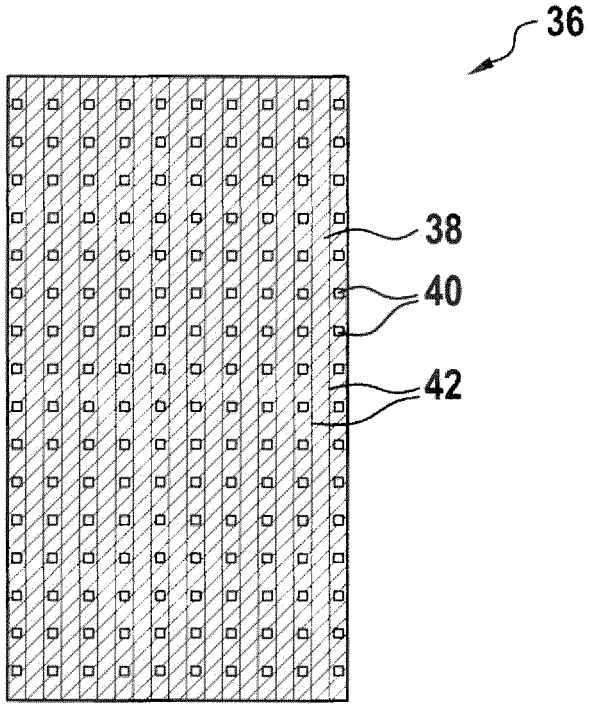
FIG. 4 is a schematic top view onto a structural body of the present disclosure.

FIG. 4 shows a structural body 36 of the present disclosure in a schematic front view or top view. This structural body 36 comprises a front glass pane as a protective layer and below it a glass panel as a carrier plate or carrier layer, on which on the side facing towards the front glass pane, a photovoltaic solar module, for example in the form of a CIGS thin layer solar module, has been created. The area 38 shown in black here illustrates the opaque photovoltaic absorber layer. The squares 40 shown in white form the aperture and can for example be obtained through laser de-layering of the thin layer solar cell before applying the front glass pane. The vertically running lines 42 shown in grey represent the monolithically integrated series connection of the solar module 38.

For a clearer representation, only 19 solar cells are indicated in the embodiment shown in FIG. 4. For the sake of completeness, it should be noted here that a thin layer solar module usually has between 60 and 120 series connected solar cells in practice. In this way, generally, correspondingly high and in some cases practical module voltages can be provided.

The embodiment shown in FIG. 4 is thus a special design in that the apertures are not attached in every, but only in every second solar cell. As a result, the photovoltaic areas with cells equipped with apertures are generally less than with the neighboring cells without apertures. Accordingly, the photocurrents generated can be less. In practice, this can lead to electrical losses during adaptation, i.e., the cell with the lowest photocurrent will then generally determine the total current of the module in series connection. Such a case can also be practically applied when the area loss as a result of the sum of all apertures in a cell is significantly lower than for the total area of the cell. Here, the area loss as a result of the apertures can, e.g., not amount to more than 10% or not more than 5%. Accordingly, according to the principle of the present disclosure such embodiments are also realizable with which apertures are installed for every second, third, fourth or generally $n^{th}$ cell. However, with regard to the minimization of the electrical adjustment losses, it is advantageous, however, that each cell contains apertures, in some cases the same number of apertures, and/or the same percentage area allocation by apertures. One advantage of the display units of the present disclosure is that through the variable design in relation to the attachment of apertures in every, every second, every third or every n-th/$n^{th}$ cell, the cell layout, the module design and/or the optical specifications can be widely varied.

Figure 5:
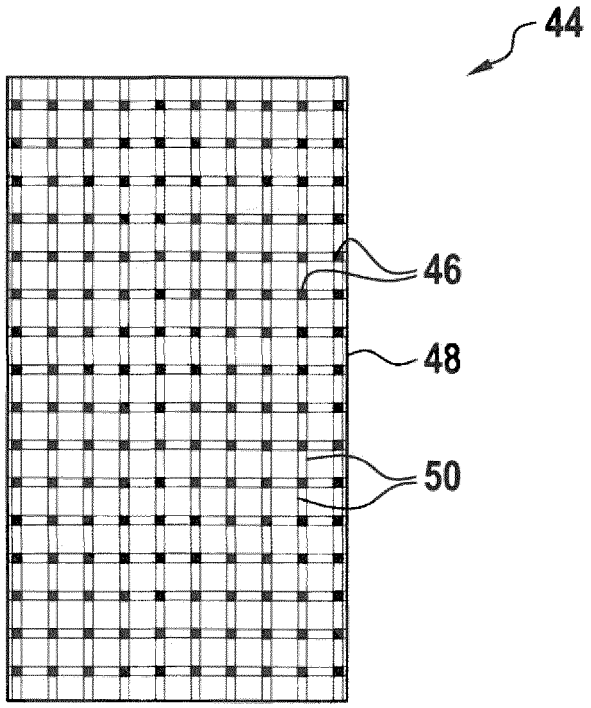
FIG. 5 is a schematic top view onto a pre-fabricated LED array.

FIG. 5 shows a pre-fabricated LED array 44 that can be combined with the structural body 36 shown in FIG. 4 to create a display unit of the present disclosure. For this purpose, the pre-fabricated LED array 44 should be attached to the rear side of the structural body 36. The individual illuminants 46 in the form of LEDs, such as RGB-LEDs, are here attached such that when connected to the structural body 36 they align with corresponding apertures 40. The LED array 44 can have holders 48 or connecting elements along its outer limits for the purpose of linking it to the structural body 36 of the present disclosure. Further, FIG. 5 shows schematically that the individual LEDs are wired to each other via corresponding lines 50.

Figure 6:
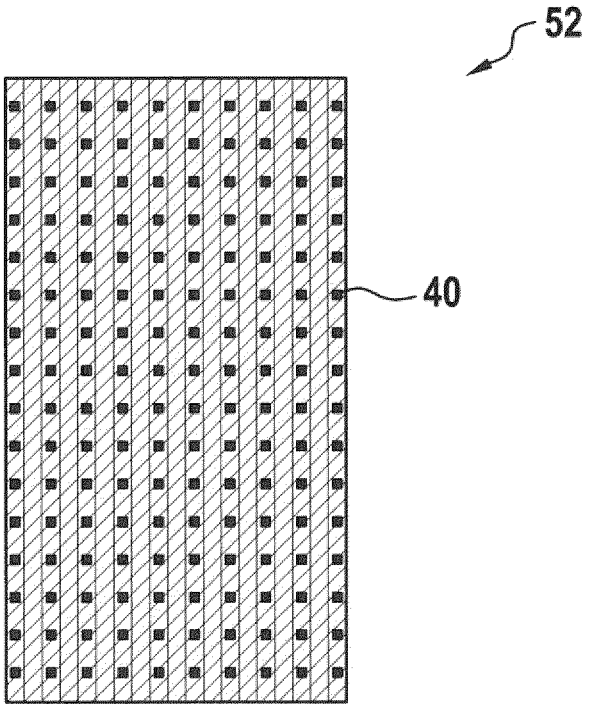
FIG. 6 is a schematic top view onto a display unit of the present disclosure when switched off.
Figure 7:
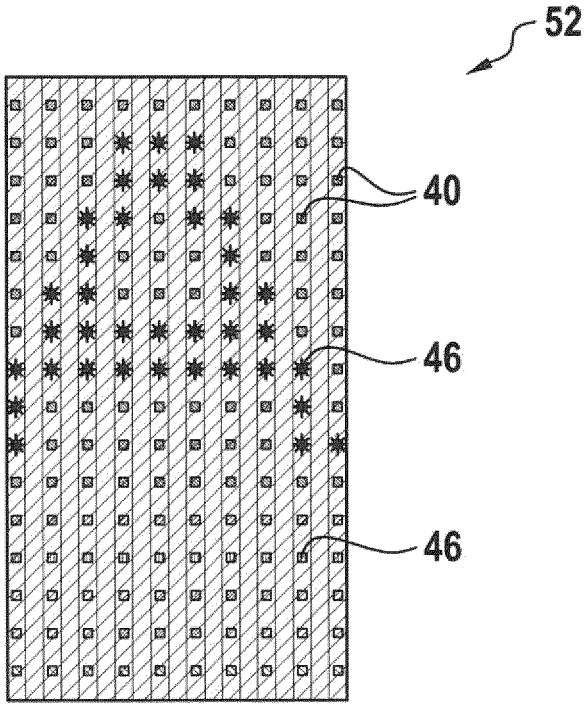

FIG. 6 shows a schematic top view of a display unit 52 of the present disclosure formed from the structural body 36 shown in FIG. 4 and the pre-fabricated LED array 44 shown in FIG. 5 when switched off. In the embodiment shown, the loss of area of the photovoltaic layer lies below 5% of the total photovoltaic area of the module, and the loss of area due to all apertures within a cell lies below 10%. As shown schematically in FIG. 7, even with such a low area occupation by the apertures 40 with the display 52 of the present disclosure, a distinctive display function can be achieved when switched on. In FIG. 7, with the display unit 52 of the present disclosure, both a clear color impression and the display of the letter "A" is produced via the plurality of LEDs 46. Accordingly, a media energy façade can be created from a plurality of display units 52 of the present disclosure, which permits a brilliant, high-illumination display of, e.g., texts, images and films on building surfaces. Thus, a homogeneous color background and color progression can be implemented.

Figure 8:
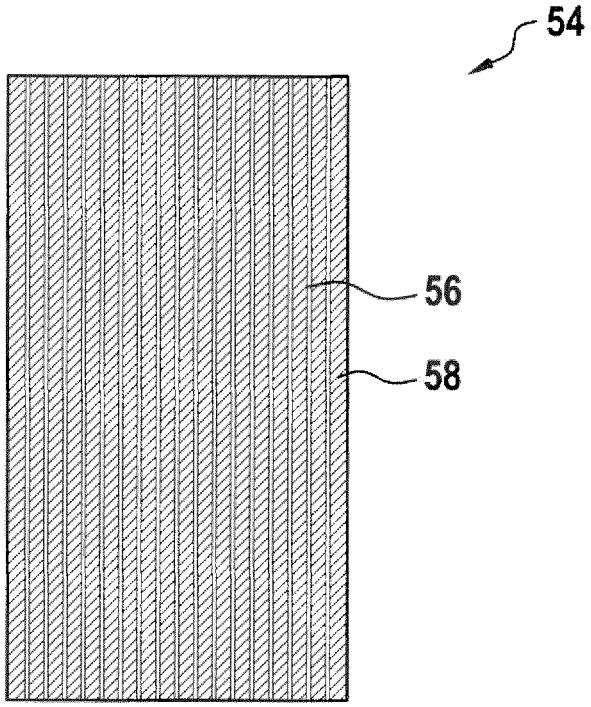
FIG. 8 is a schematic top view onto a display unit of the present disclosure when switched off.

FIG. 8 shows a further embodiment of a display unit 54 of the present disclosure. Unlike with the embodiment of the display unit shown in FIG. 6, with the embodiment shown in FIG. 8, the apertures 56 are linear and are arranged parallel to each other. The area 58 shown in black is the opaque photovoltaic absorber layer of the photovoltaic solar module, such as a CIGS thin layer solar module. The loss of area of the photovoltaic layer 58 due to the apertures in the form of transparent lines lies below 0.5% with the embodiment shown in FIG. 8. The display unit 54 of the present disclosure, like the display unit shown in FIG. 6, contains a front glass pane as a protective layer and a glass substrate as a carrier layer, on which the photovoltaic solar module is present on the side facing towards the front glass pane. The transparent structural lines that form the apertures 56 can be used in one advantageous embodiment for monolithically integrated series connection. This is in some cases achieved due the fact that the series connection is switched off such that at least the first structuring separating channels are created at the earliest after the production of the photovoltaic semiconductors, and that these structuring separating channels are filled with a transparent filler material. This construction makes it possible, in an advantageous manner, to do without additional apertures. On the rear side of a carrier pane, an LED array may be present, for example, which contains a plurality of illuminants (not shown). These are optionally located in alignment with the transparent, linear apertures 56. In the embodiment shown in FIG. 8, the loss of area due to the apertures is the same in every cell. As a result, in general, no electrical adjustment losses occur. In the case of the design with series connection with transparent structuring separating channels, a loss of area resulting from the apertures is generally zero, in some cases when only the separating channels are intended for use as apertures.

Figure 9:
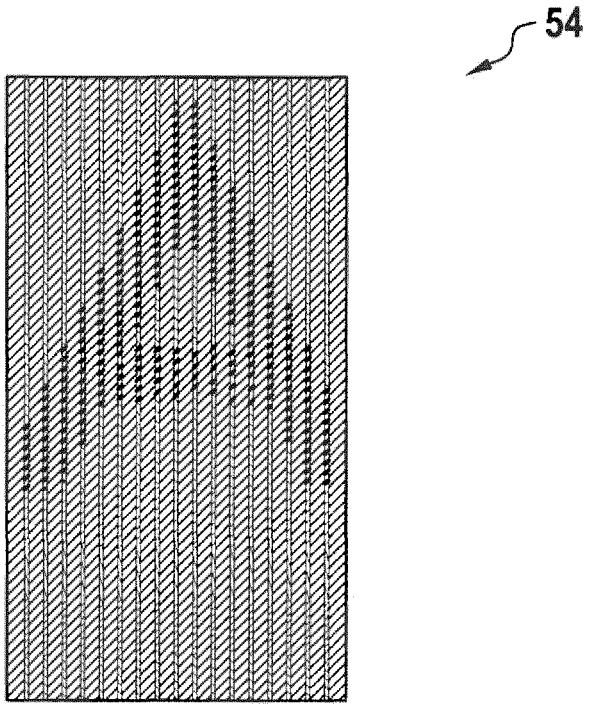

When switched on, as can be seen in FIG. 9, letters or symbols can be shown against a homogeneous color background via the display unit 54 of the present disclosure shown in FIG. 8. As can further be seen in FIG. 9, a color progression is also possible. When shown on the display units 54 of the present disclosure, as shown in FIGS. 8 and 9, large displays can be created, e.g., for media energy façades. In some cases, when the proportion of the area used for the apertures is kept very low, it has been shown to be advantageous to provide a diffusing pane (not shown) between the illuminants and the apertures.

The features of the present disclosure disclosed in the above description, in the claims and in the drawings can be essential both individually and in any combination required for the realization of the present disclosure in its different embodiments.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display unit, comprising:

a1) a transparent or translucent layer with a display side and a rear side, with at least one opaque or semitransparent layer on the display side, containing a plurality of apertures;

b1) a plurality of illuminants which are present on or at a distance from the rear side of the transparent or translucent layer, or are partly or fully embedded in the transparent or translucent layer, wherein at least one illuminant is present substantially behind one of the apertures, in each case configured and designed to emit light in the direction of said aperture and through said aperture;

c1) a transparent or translucent lamination ply indirectly or directly adjoining the opaque or semitransparent layer and covering the plurality of apertures; and d1) a transparent or translucent protective layer adjoining said transparent or translucent lamination ply;

or a2) a transparent or translucent layer with a display side and a rear side, containing at least one opaque or semitransparent layer on the rear side, containing a plurality of apertures; and b2) a plurality of illuminants which are present behind and/or partly or fully in the opaque or semitransparent layer, and wherein at least one illuminant is arranged in an area of an aperture, in each case configured and designed to emit light in the direction of said aperture and through said aperture;

or a3) an opaque or semitransparent carrier plate with a rear side and an opposite display side containing a plurality of apertures; and b3) a plurality of illuminants on the rear side of the opaque or semitransparent carrier plate, wherein the apertures are closed or filled with a transparent or translucent material, and/or c3) wherein at least one weather protection layer and/or diffusor layer is present between the opaque or semitransparent carrier plate and the plurality of illuminants, wherein, in case of a1), b1), c1), and d1), or in case of a2) and b2), or in case of a3), b3), and c3), at least one photovoltaic solar cell or at least one photovoltaic solar module:

is present on or at the display side of the opaque or semitransparent layer or the opaque or semitransparent carrier plate, is contained in or forms the opaque or semitransparent layer, or is present on or connected to the rear side of the transparent or translucent layer or the opaque or semitransparent carrier plate.

2. The display unit according to claim 1, wherein:

the transparent or translucent layer, or the opaque or semitransparent carrier plate, or the opaque or semitransparent layer is single- or multilayered, or the opaque or semitransparent layer or the opaque or semitransparent carrier plate is single- or multilayered, and contains at least one opaque or semitransparent layer.

3. The display unit according to claim 1, wherein the apertures in the opaque or semitransparent layer are filled with a transparent or translucent material.

4. The display unit according to claim 1, wherein:

light emitted by an illuminant passes in part through a corresponding aperture, and/or the illuminant is in each case centered to at least one geometrical axis of the corresponding aperture, and/or the illuminants are each located in alignment with corresponding apertures and/or in front of and/or behind an aperture, and at least one lens and/or at least one prism and/or at least one diffusor is present.

5. The display unit according to claim 1, wherein the apertures are linear having the form of slit apertures, or substantially are circular, rectangular, or square apertures.

6. The display unit according to claim 1, wherein the transparent or translucent layer and/or the transparent or translucent protective layer is or comprises a glass disc, a window glass disc, or a transparent or translucent plastic plate or foil.

7. The display unit according to claim 1, wherein the illuminant is selected from the group consisting of LEDs, OLEDs, laser diodes, and mixtures thereof, and wherein the LEDs are selected from the group consisting of wired LEDs, SMD-LEDs, and RGB-LEDs.

8. The display unit according to claim 1, wherein the opaque or semitransparent layer is or contains a coating that is sputtered on or evaporated, or applied using a CVD method or a wet chemical or electrochemical separation method, facing the plurality of illuminants, and containing the apertures.

9. The display unit according to claim 1, wherein the apertures are formed using laser treatment of areas of the opaque or semitransparent layer, or using lithographic methods, milling, plasma cutting, laser cutting, electron beam cutting, glass bead blasting, sandblasting, etching methods and/or water jet cutting.

10. The display unit according to claim 1, further containing at least one temperature, humidity, visibility, and/or vibration sensor, and/or at least one camera unit.

11. The display unit according to claim 10, further comprising at least one wire connected or wireless data processing device that is configured and designed to provide information on the display unit, wherein illuminants are selectively triggerable, in order to store, transfer, and/or evaluate the data recorded by the temperature, humidity, visibility and/or vibration sensor and/or the at least one camera unit.

12. The display unit according to claim 10, wherein electrical energy for operating the illuminants and/or the at least one temperature, humidity, visibility and/or vibration sensor and/or the at least one camera unit is providable at least partly from a photovoltaic solar cell or from a photovoltaic solar module or from at least one energy storage system.

13. The display unit according to claim 1, wherein:

the average or maximum width of at least one linear aperture is smaller or equal to 100 μm, and/or the average lateral space apart of adjacent apertures and/or illuminants lies in the range of 0.1 cm to 10 cm.

14. The display unit according to claim 1, wherein:

an average or maximum width of at least one aperture is less than or equal to 15 mm and/or an average lateral space apart between adjacent apertures and/or illuminants is in a range of 100 times the average or maximum width of the aperture.

15. The display unit according to claim 1, wherein, in the case where the at least one photovoltaic solar cell or the at least one photovoltaic solar module is present on or connected to the rear side of the transparent or translucent layer or the opaque or semitransparent carrier plate, the apertures are present between adjacent photovoltaic solar cells or between adjacent photovoltaic solar modules, or the apertures are based on structures of the photovoltaic solar cells or photovoltaic solar modules.

16. The display unit according to claim 1, wherein, in the case where the at least one photovoltaic solar cell or the at least one photovoltaic solar module is present on or connected to the rear side of the transparent or translucent layer or the opaque or semitransparent carrier plate, the apertures overlap with the corresponding photovoltaic solar cells.

17. The display unit according to claim 1, wherein the at least one photovoltaic solar cell or the at least one photovoltaic solar module is based on polycrystalline silicon, multicrystalline silicon, monocrystalline silicon, amorphous silicon, chalcopyrite systems, kesterite systems, perovskite systems, cadmium/telluride systems, or organic systems.

18. The display unit according to claim 17, wherein the chalcopyrite systems are based on $Cu(In_{1-x}Ga_x)(Se_{1-y}, S_y)$ wherein x and y assume values between 0 and 1.

19. The display unit according to claim 1, wherein the at least one solar module comprises a plurality of monolithically integrated, serially connected solar cells, which are in each case separated from each other by apertures.

20. The display unit according to claim 1, further comprising at least one energy storage system that is feedable with electrical energy from the at least one photovoltaic solar cell or the at least one photovoltaic solar module.

21. A display apparatus having a front and rear side, containing at least one display unit according to claim 1.

22. The display apparatus according to claim 21, wherein:

the rear side of at least one first display unit according to claim 1, and the rear side of at least one second display unit according to claim 1, face each other and are at a distance from each other and are arranged forming an interim space, or the rear side of at least one display unit according to claim 1, and the rear side of at least one photovoltaic solar cell or at least one photovoltaic solar module, face each other and are at a distance from each other and are arranged forming an interim space.

23. The display apparatus according to claim 22, wherein, in the interim space, at least one temperature, humidity, visibility and/or vibration sensor and/or at least one camera unit and/or at least one energy storage system, and/or a charging regulation and/or at least one wire connected or wireless data processing device and/or control are arranged.

24. The display apparatus according to claim 22, wherein the interim space has circumferential side walls.

25. The display apparatus according to claim 21, further comprising at least one window glass disc containing a rear and an opposite front-side glass disc side, equipped with a plurality of illuminants in the form of LEDs, OLEDs or laser diodes, wherein the plurality of illuminants is covered with a transparent or translucent material.

26. The display apparatus according to claim 21, wherein the entire front side and/or the entire rear side or a partial area of the front side and/or a partial area of the rear side has at least one photovoltaic solar cell or at least one photovoltaic solar module.

27. A traffic guidance system, comprising at least one display unit according to claim 1.

28. Use of a display unit according to claim 1 as a media energy façade or as a daylight display or as a component of a daylight display or a media energy façade.

29. The display unit according to claim 1, further comprising, following the plurality of illuminants of b2):

c2) a transparent or translucent lamination ply and/or a protective layer indirectly or directly adjoining the opaque or semitransparent layer and covering the plurality of apertures.

30. The display unit according to claim 29, further comprising, following the transparent or translucent lamination ply and/or protective layer of c2):

d2) a carrier layer adjoining the opaque or semitransparent layer or on the lamination ply or the protective layer.

31. The display unit according to claim 30, further comprising, following the carrier layer of d2):

e2) at least one mounting element connected to the carrier layer.

32. The display unit according to claim 1, wherein the at least one photovoltaic solar module is a photovoltaic thin layer solar module that is distinct from solar modules that are otherwise based on polycrystalline silicon, multicrystalline silicon, monocrystalline silicon, and amorphous silicon.

33. The display unit according to claim 32, wherein the photovoltaic thin layer solar module is based on a chalcopyrite system.

34. A structural body for a display unit comprising:

a first embodiment, comprising:

a1) a transparent or translucent layer with a display side and a rear side, containing at least one opaque or semitransparent layer on the display side, containing a plurality of apertures; and b1) a plurality of illuminant inlets and/or holders, which are present on or at a distance from the rear side of the transparent or translucent layer, or are partly or fully embedded in the transparent or translucent layer, wherein at least one illuminant inlet and/or holder is present substantially behind or in one of the apertures; or a second embodiment, comprising:

a2) a transparent or translucent layer with a display side and a rear side, containing at least one opaque or semitransparent layer on the rear side, containing a plurality of apertures; and b2) a plurality of illuminant inlets and/or holders, wherein the illuminant inlets and/or holders are present behind and/or partly or fully in the opaque or semitransparent layer and wherein in each case, at least one illuminant inlet and/or holder is arranged in an area of an aperture; or a third embodiment, comprising:

a3) an opaque or semitransparent carrier plate with a rear side and an opposite display side containing a plurality of apertures; and b3) a plurality of illuminant inlets and/or holders on the rear side of the opaque or semitransparent carrier plate, wherein, in case of the first embodiment, or in case of the second embodiment, or in case of the third embodiment, at least one photovoltaic solar cell or at least one photovoltaic solar module:

is present on or at the display side of the opaque or semitransparent layer or the opaque or semitransparent carrier plate, is contained in or forms the opaque or semitransparent layer, or is present on or connected to the rear side of the transparent or translucent layer or the opaque or semitransparent carrier plate.

35. The structural body according to claim 34, wherein:

the first embodiment further comprises:

c1) a transparent or translucent lamination ply indirectly or directly adjoining the opaque or semitransparent layer and covering the plurality of apertures, and d1) a transparent or translucent protective layer adjoining said transparent or translucent lamination ply; or the third embodiment further comprises:

the apertures according to a3) that are closed or filled with a transparent or translucent material; and/or c3) at least one weather protection layer and/or diffusor layer that is present between the opaque or semitransparent carrier plate and the plurality of illuminant inlets and/or holders.

36. A display unit, comprising:

a1) a transparent or translucent layer with a display side and a rear side, with at least one opaque or semitransparent layer on the display side, containing a plurality of apertures;

b1) a plurality of illuminants which are present on or at a distance from the rear side of the transparent or translucent layer, or are partly or fully embedded in the transparent or translucent layer, wherein at least one illuminant is present substantially behind one of the apertures, in each case configured and designed to emit light in the direction of said aperture and through said aperture;

c1) a transparent or translucent lamination ply indirectly or directly adjoining the opaque or semitransparent layer and covering the plurality of apertures;

d1) a transparent or translucent protective layer adjoining said transparent or translucent lamination ply, and e1) following the transparent or translucent protective layer of d1), at least one mounting element connected to the rear side of the transparent or translucent layer.

* * * * *